United States Patent [19]

Focke

[11] 4,258,526

[45] Mar. 31, 1981

[54] METHOD AND APPARATUS FOR BRINGING ARTICLES TOGETHER IN A PACKAGING MACHINE

[75] Inventor: Heinz Focke, Verden, Fed. Rep. of Germany

[73] Assignee: Focke & Co., Verden, Fed. Rep. of Germany

[21] Appl. No.: 8,214

[22] Filed: Jan. 31, 1979

[30] Foreign Application Priority Data

Feb. 15, 1978 [DE] Fed. Rep. of Germany ..... 2806263

[51] Int. Cl.[3] ..... B65B 43/50; B65B 19/18

[52] U.S. Cl. ..... 53/399; 53/449; 53/169; 53/566

[58] Field of Search ..... 53/169, 458, 566, 399, 53/449, 176

[56] References Cited

U.S. PATENT DOCUMENTS

| | | | |
|---|---|---|---|
| 1,064,452 | 6/1913 | Denmead et al. | 53/169 X |
| 1,326,187 | 12/1919 | Donnelly | 53/169 |
| 3,633,470 | 1/1972 | Bingham | 53/566 X |

FOREIGN PATENT DOCUMENTS

| | | |
|---|---|---|
| 2308714 | 8/1973 | Fed. Rep. of Germany . |
| 2244533 | 4/1974 | Fed. Rep. of Germany . |
| 139969 | 5/1930 | Switzerland . |

*Primary Examiner*—Horace M. Culver

*Attorney, Agent, or Firm*—Sughrue, Rothwell, Mion, Zinn and Macpeak

[57] ABSTRACT

Slides 12 previously filled with cigarettes are inserted into opened rectangular sleeves 11 by introducing the slides and sleeves into respective radial pockets of adjacent coaxial turrets 19, 20 of equal diameter and rotating at the same speed, and then pushing the slides into the sleeves by cam controlled rams 23. The flattened sleeves are initially fed to the underside of turret 20 and lifted by rocker 16 against suction holders 22 of the turret pockets, whereafter they are opened or erected by an overfolding and release sequence during the rotation of the turret. The slides are brought in on a linear conveyor 15, elevated into pockets 61 of a radially armed transfer apparatus 13 by a lifter 83, and thereafter tangentially delivered into the pockets of turret 19 for engagement by the fixed and pivotal pocket side walls 24, 25. The insertion of the slides into the sleeves is facilitated by four pivotal and axially movable guides 52 provided at the entry corners of each sleeve.

17 Claims, 18 Drawing Figures

Figure 1:
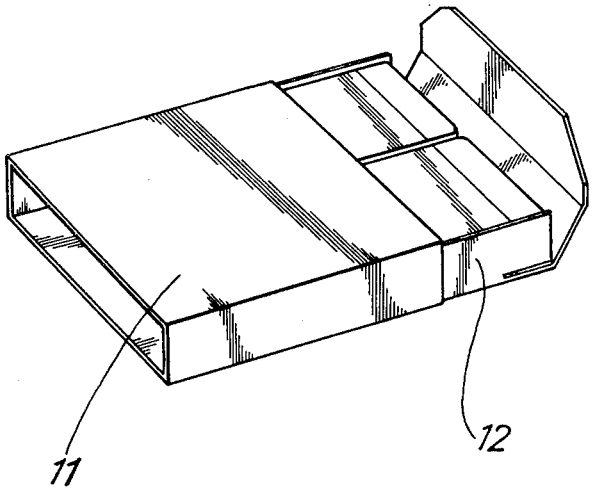

VI
66
13
70
72
77
76
73
75
74
63
65
79
62
78
61
12
33
24
61
63
65
69
66
79
VIII
61
72
66
VIII
25
89
65
81 (82)
80
12
83
90 (91)
60
94
59
14
15
97
99
95
86
98
88 (87)
96
VI

METHOD AND APPARATUS FOR BRINGING ARTICLES TOGETHER IN A PACKAGING MACHINE

The present invention relates to a process and an apparatus for bringing articles together in a packaging machine, in particular for introducing contents into a package.

The problem of bringing articles together occurs very frequently in the packaging industry. In the main, what is involved is the introduction of contents into a package, which is partially finished or open at one side. An example is the production of cigarette packs of the "slide and sleeve" type. The process of bringing two articles together consists of having to introduce the slide, filled with the package contents, into the set-up sleeve.

It is the object of the present invention to propose a process and an apparatus for bringing articles together, in particular for introducing the contents of a pack into the pack, which is at least partially open.

This object is achieved by a process according to the invention characterised in that the articles to be brought together (for example the slide and sleeve) are conveyed coaxially and with the same speed each along coaxial circular tracks of the same diameter and are combined with one another by axial shift of at least one of the articles. Accordingly, the articles run parallel next to one another on circular tracks and are brought together by a movement of at least one of the articles in the axial direction.

The advantage of this process resides firstly in the continuous method of operation, which always results in higher productivity of the packaging machine concerned. Further, the process permits a compact construction of the relevant part of the packaging machine, though the bringing-together of the articles may extend over a fairly long distance of travel.

The invention further relates to a special transfer apparatus, by means of which the articles, for example the contents of the package, are taken from one transport track and are fed, with acceleration, to the continuously revolving turret. According to the invention, the articles are, for this purpose, moved, and accelerated, along an arc-shaped conveyor track which is axially parallel to the turret and are thereafter conveyed into the immediate vicinity of the particular turret or into the track in which a pocket or a holder thereof travels. For this purpose, the articles are picked up by driver pockets of the transfer apparatus and are transferred, without relative movement in the axial direction or radial direction, to the holder of the continuously revolving turret.

A lifting apparatus of special construction is also provided, by means of which the articles are lifted off a conveyor, in particular a linear conveyor, and are fed to the transfer apparatus.

The invention further relates to an alternative for feeding articles to a revolving turret, in the present case the feeding of a flat cut-out in order to form a sleeve of a package of the "slide and sleeve" type. According to the invention, a rocker, preferably driven at one end by a crank and at the other end by a rocker arm, is provided, which rocker arm is so moved by this mechanism that the article located on the rocker (the flat cut-out) is fed in the radial direction to the periphery of the turret and for a short section travels with the latter in the circumferential direction, with instantaneous acceleration.

Finally, the invention relates to an erector, which in this case is allotted to the turret for receiving the package (sleeve). The erector, which travels with the turret for part of the distance, folds the flat cut-out into the three-dimensional shape of the package or sleeve, whilst the turret continues to move. This erector can again be employed independently of the other features, according to the invention, of the apparatus.

An illustrative embodiment of the apparatus according to the invention is explained in more detail below, with the aid of the drawings.

Figure 2:
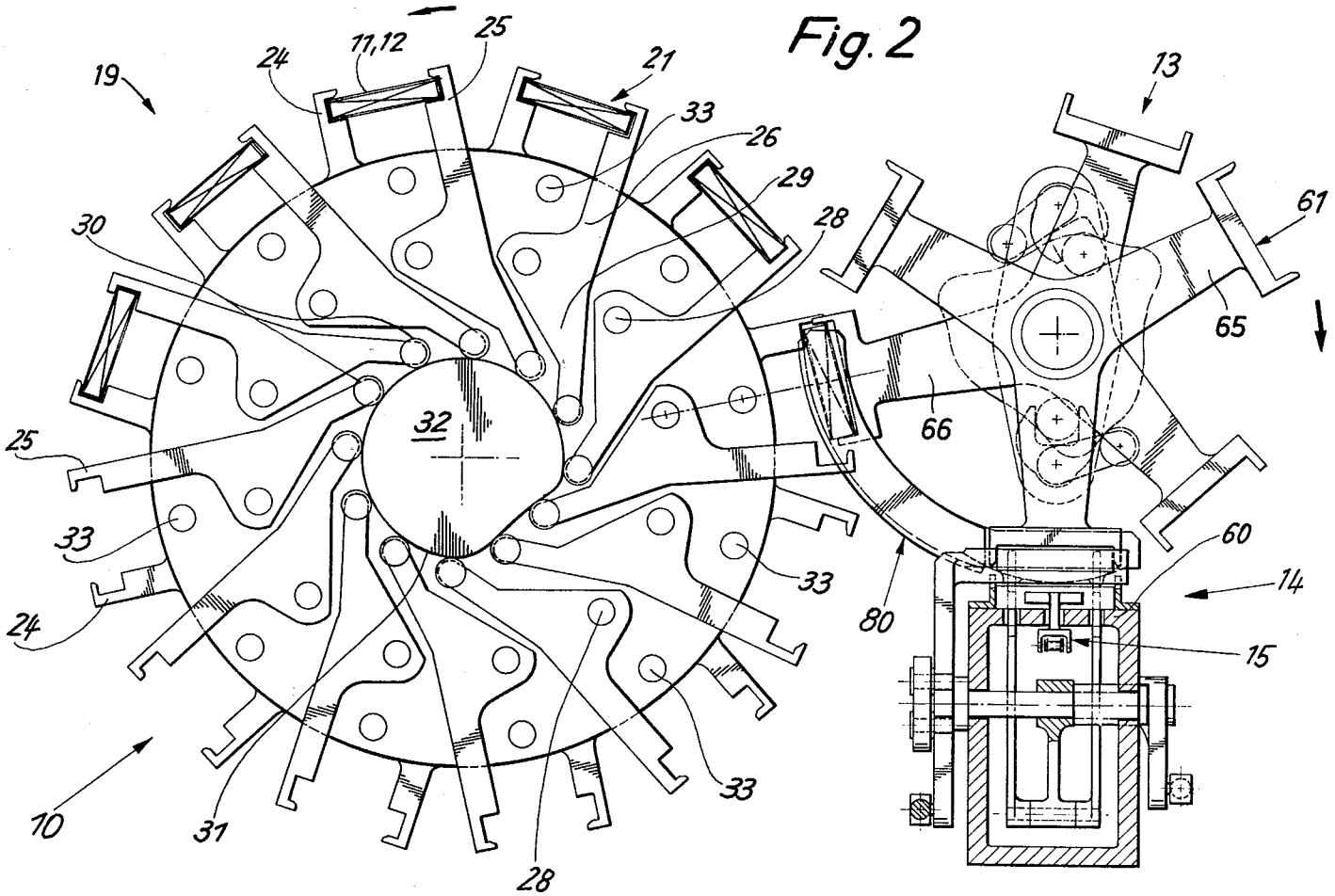
Figure 3:
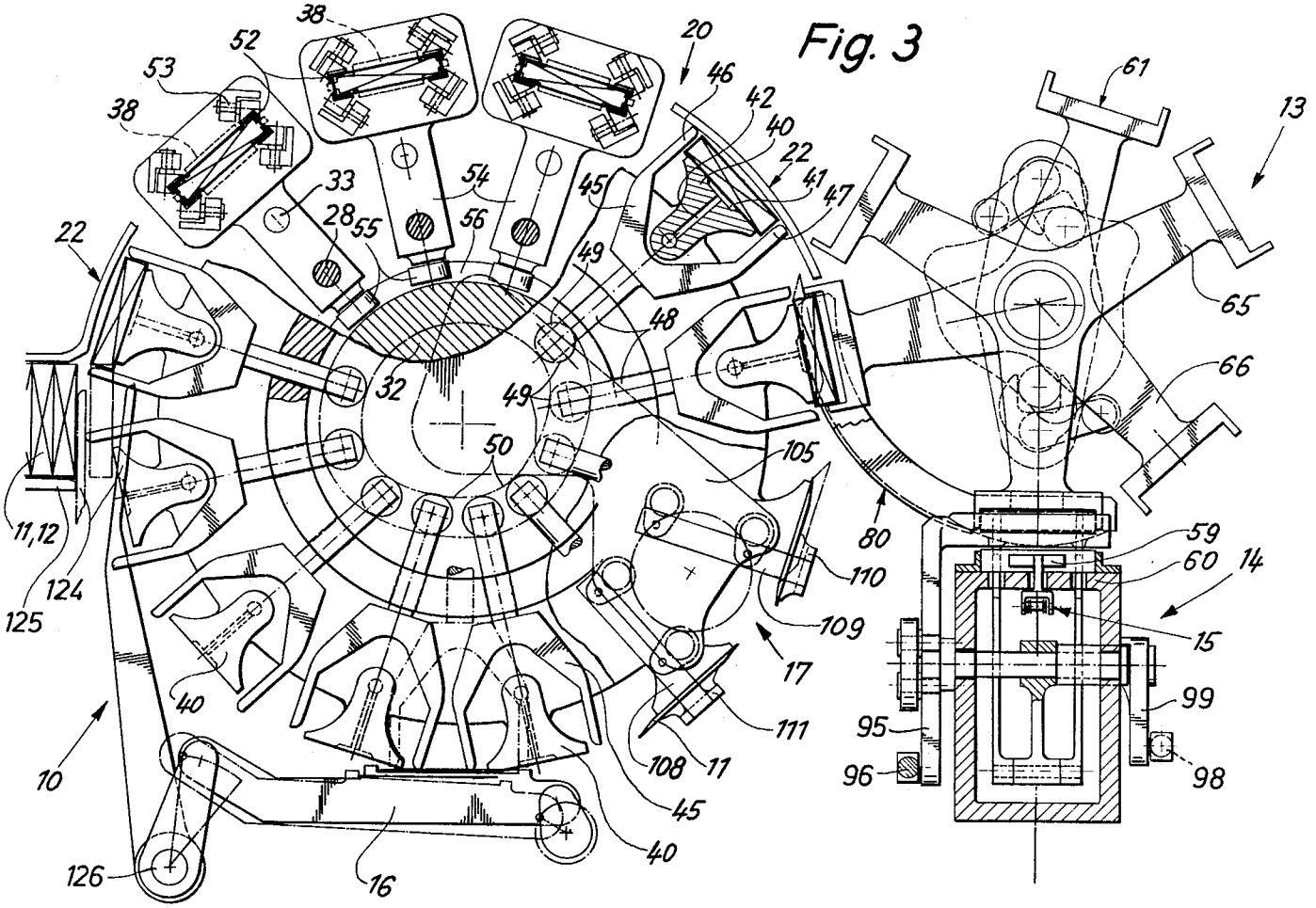
Figure 4:
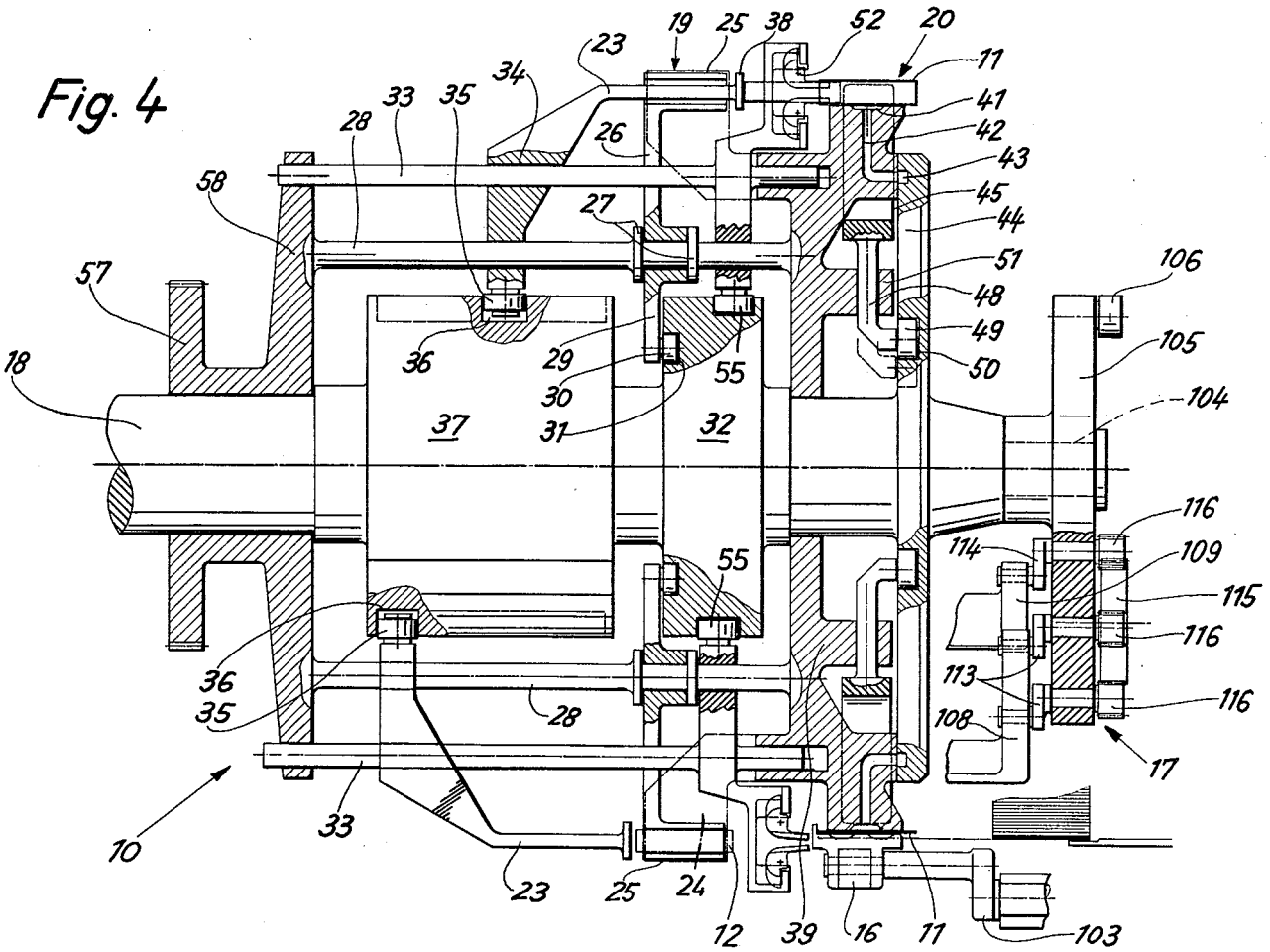
Figure 5:
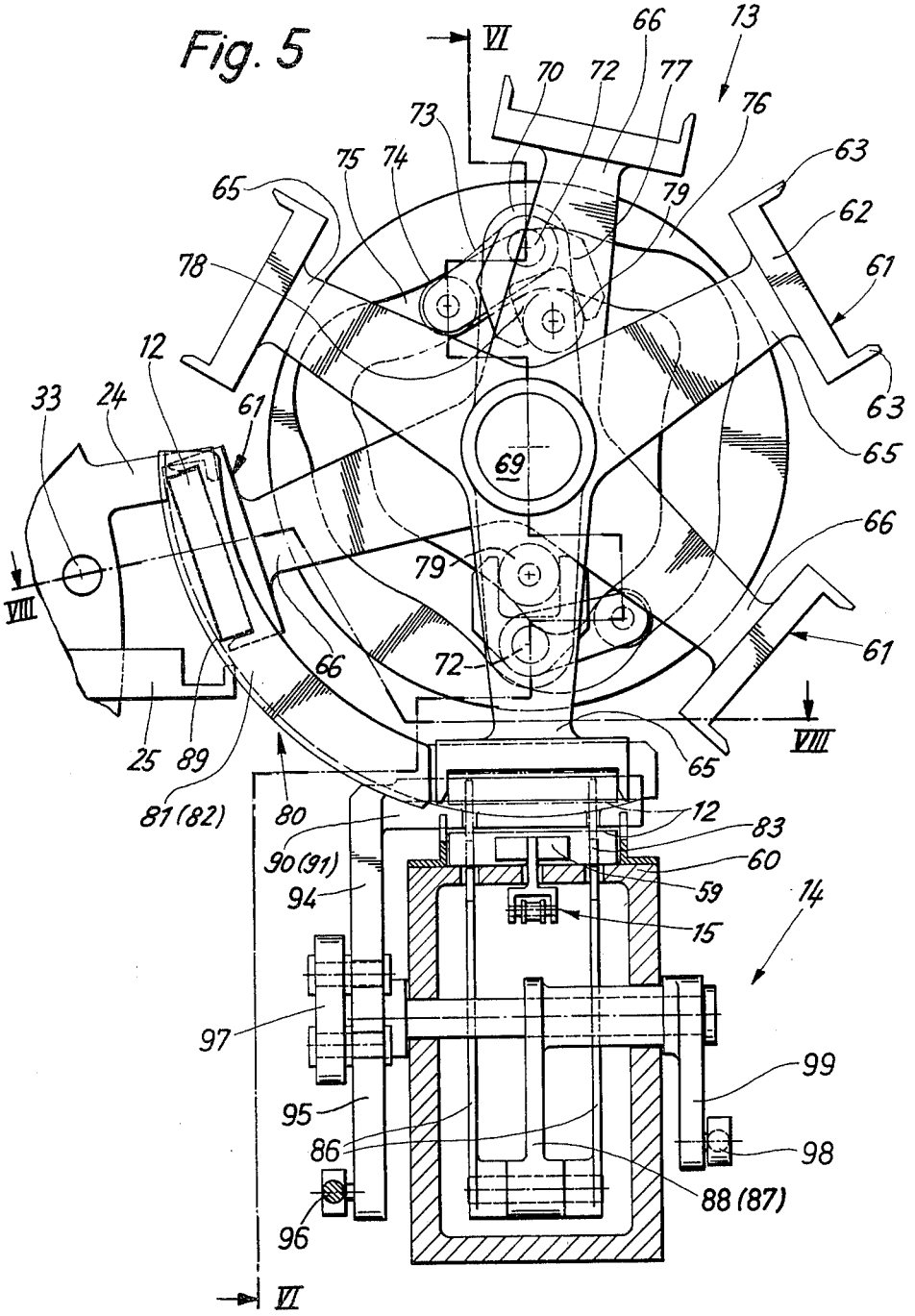
Figure 6:
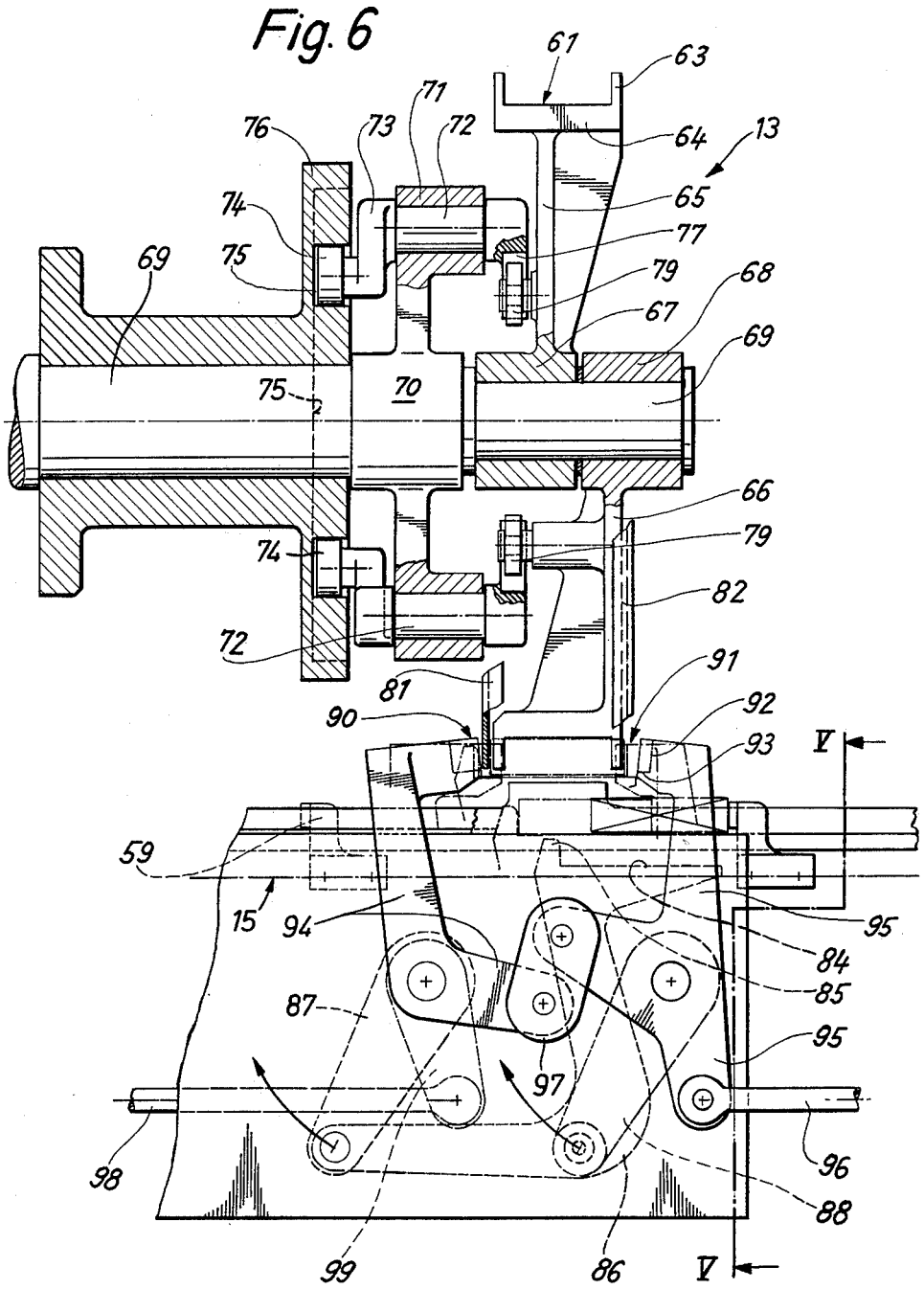
Figure 7:
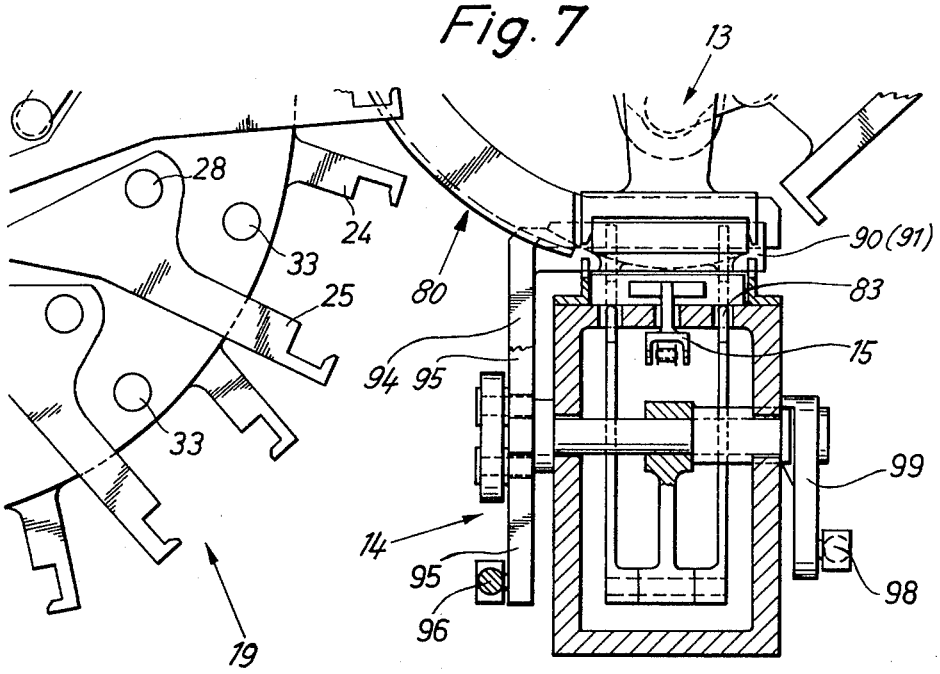
Figure 8:
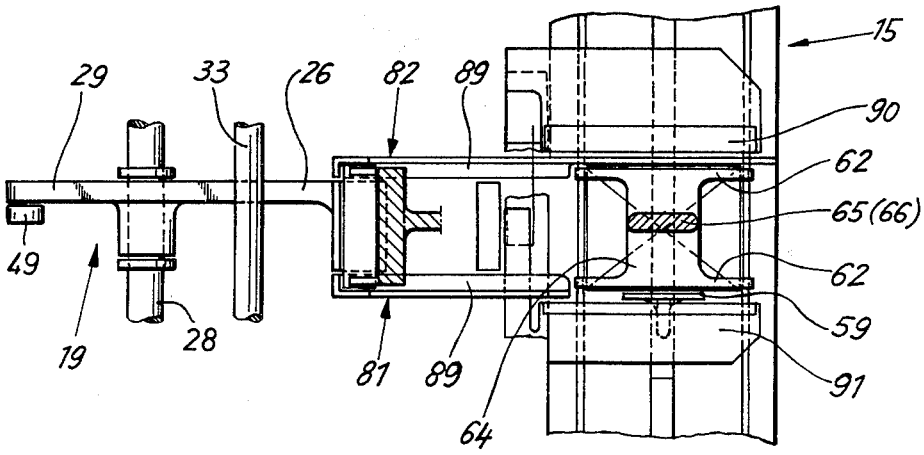
Figure 9:
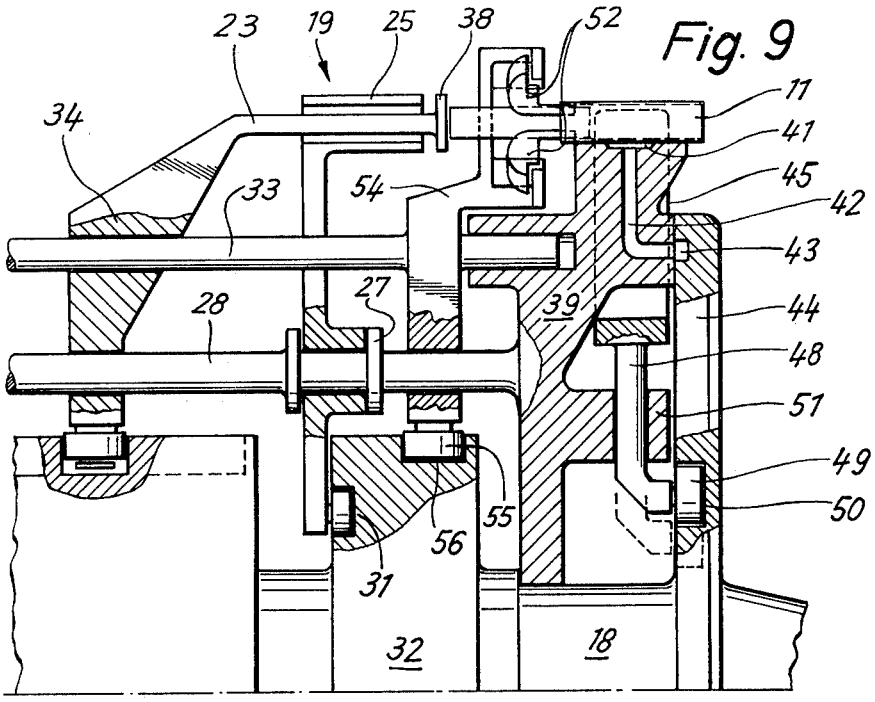
Figure 10:
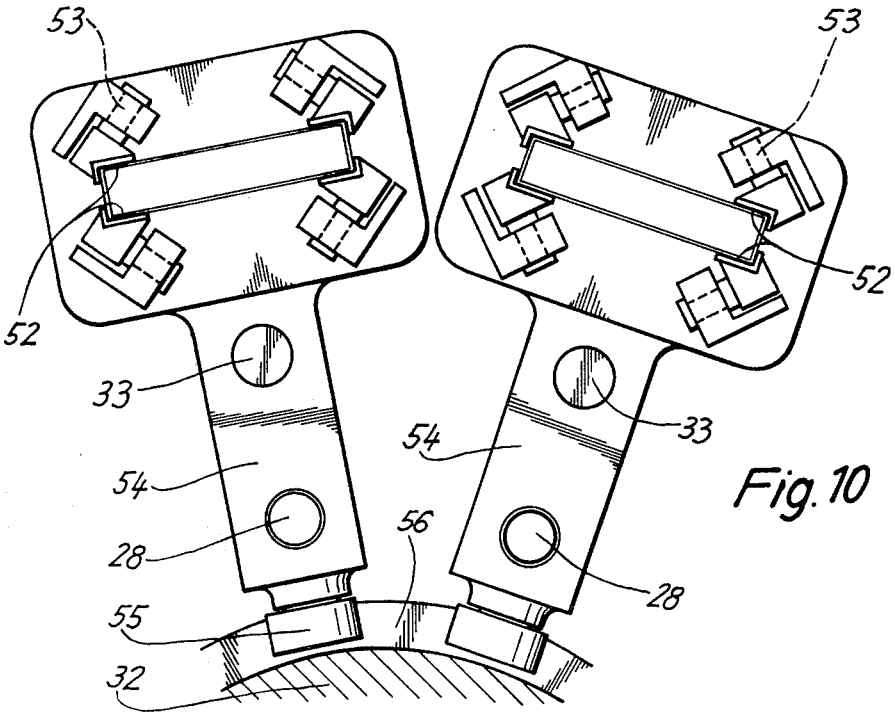
Figure 11:
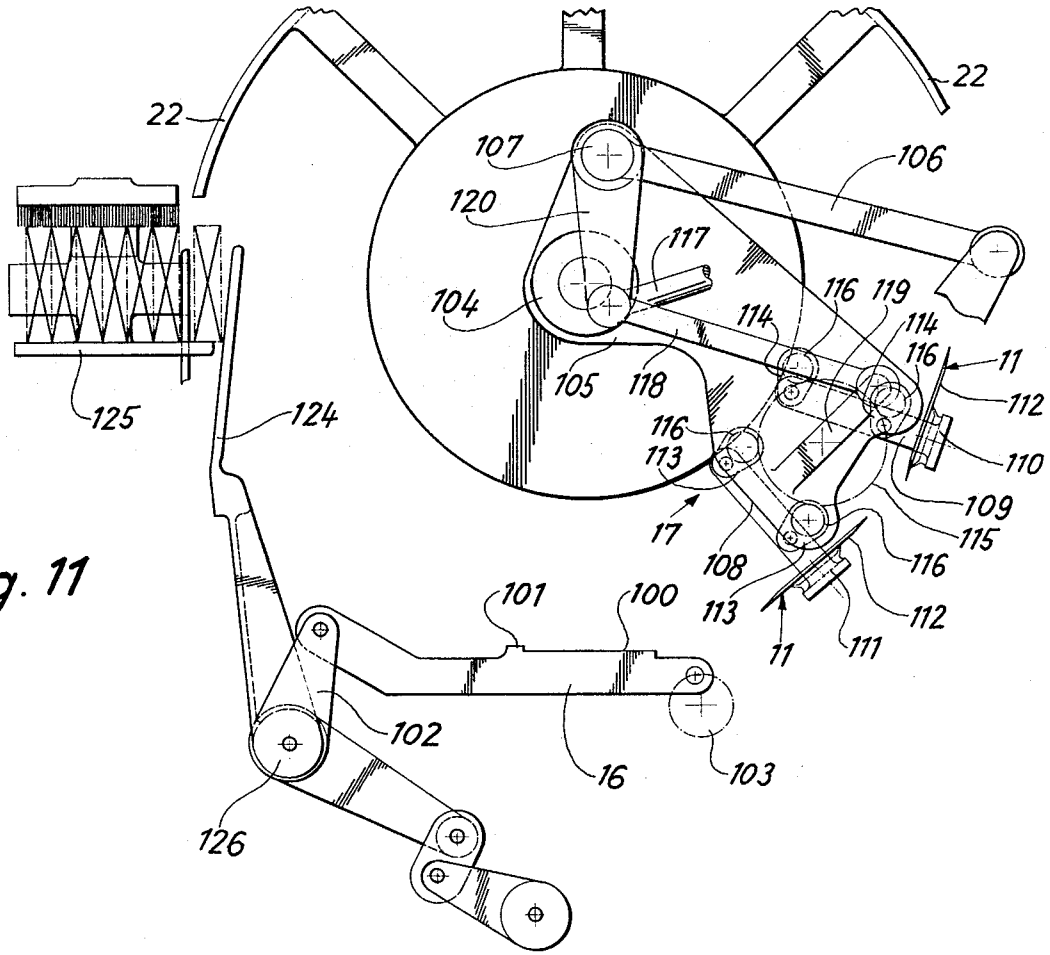

In these:

FIG. 1 shows, in perspective, a cigarette pocket of the "slide and sleeve" type, FIG. 2 shows a part of the apparatus for bringing articles together, in particular for bringing together the slide and sleeve of a package according to FIG. 1, in greatly simplified side view, FIG. 3 shows a view corresponding to FIG. 2, with other details of the apparatus, on a somewhat enlarged scale, FIG. 4 shows a longitudinal view, partially in section, of the apparatus according to FIGS. 2 and 3, FIG. 5 shows a detail of the apparatus, namely a transfer apparatus for articles, especially parts of a package, in side view, partially in section, FIG. 6 shows the transfer apparatus according to FIG. 5 in longitudinal view, partially in longitudinal section, FIG. 7 shows an apparatus for feeding articles to the transfer apparatus according to FIGS. 5 and 6, namely a lifting apparatus, in cross-section, FIG. 8 shows a section VIII—VIII in FIG. 5, FIG. 9 shows a detail of the representation in FIG. 4, on an enlarged scale, FIG. 10 shows a detail of FIG. 9, in a view rotated through 90°, on an even more enlarged scale, FIG. 11 shows details of the apparatus, namely a rocker for transferring articles to a turret and a package erector, with omission of further details of the apparatus, in side view, and FIGS. 12 to 17 show various positions of the erector in simplified representation, in side view.

The apparatus shown in the drawings consists of several co-operating individual units, which co-operate optimally but can also be employed in other contexts. A unit 10 for bringing articles together allows such articles to be combined with one another on a continuous motion basis. In the present case, these articles are, on the one hand, a sleeve 11 and, on the other hand, a filled slide 12 of a cigarette pack of the "slide and sleeve" type, shown by way of example in FIG. 1. A transfer apparatus 13 serves to feed articles—in the present case a filled slide 12—to a revolving turret. This transfer apparatus 13 is preceded by a lifting apparatus 14, by means of which the articles are transferred, from a conveyor 15, which in the present case follows a linear path, to the lifting apparatus 14. FIG. 11 shows details of a rocker 16 which moves in a particular manner, again for the transfer of articles to a revolving turret. In the present case, these articles are flat stacked cut-outs for forming the sleeve 11. Finally, attention should be directed to an erector 17, also shown in FIG. 11, by means of which, whilst the turret is moving, the cut-outs picked up by the turret, especially the cut-outs intended for the sleeve 11, can be erected.

The unit 10 for bringing the articles together (see, in particular, FIG. 4) is a very compact structure. Two turrets 19 and 20 are rotatably mounted on a shared main axle 18. Each of these turrets 19, 20 serves to receive articles which are to be combined with one another. In the present instance, the turret 19 picks up the slide 12, containing the cigarettes, in pockets 21, whilst the sleeves 11 are transported in holders 22 of the turret 20. The two turrets 19 and 20 run continuously and at the same speed, and in such a way that the pockets 21 and holders 22 are opposite one another in the axial direction. The slide and sleeve are brought together through the slides 12 being expelled by rams 23 from the pockets 21, in the axial direction, and being pushed into the open sleeves 11 in the holders 22 of the turret 20. Accordingly, an axial shaft of the slides 12 takes place during the rotation of the turrets 19, 20.

In the present instance, the turret 19 is formed by pockets 21 which consist solely of two lateral U-shaped side walls 24 and 25 (FIG. 2). One side wall 24 is fixed whilst the side wall 25 is part of a pivoted lever 26. The latter is rotatably mounted on a support rod 28 between stops 27. Corresponding to the number of pockets 21, several support rods 28 are arranged axially parallel to the main axis 18 and at a distance from the latter.

In order to receive the articles, namely the slides 12, in the pockets 21, the movable side wall 25 can be retracted by appropriate movement of the pivoted lever 26. This opening and closing movement of the pocket 21 or of the pivoted lever 26 can be controlled by an extension 29 of the pivoted lever 26. This extension engages, by a sensor roll 30, in a control slot 31 of a control disc 32 which is fixed, namely mounted on the main axle 18. The support rods 28 revolve round the main axle 18 along a circular track. During this revolution, the opening and closing movements of the pocket 21 are derived from the control slot 31 via the sensor roll 30.

Guide rods 33 are located at a distance from the support rods 28 and parallel to the latter. These guide rods and the support rods 28 each respectively serve as a sliding mounting for the ram 23 or an arm 34 thereof. The ram 23 can as a result slide exclusively in the axial direction on the support rod 28 and the guide rod 33.

In order to execute the controlled reciprocating movements of the ram 23, the end of the arm 34 is provided with a sensor roll 35, located in a control slot 36 on the periphery of a control drum 37. This control drum is also fixedly mounted on the main axle 18. The dimensions of the ram 23, and of the head 38 thereof, are such that this part can move between the side walls 24 and 25 of the pocket 21.

The turret 20 is formed by a turret plate 39, which is rotatably mounted on the main axle 18. The holders 22 are formed on the outer periphery of the turret plate 39, in identical arrangement and relative position. In the present case, these holders consist of a support block 40 which is mounted directly on the turret plate 39 and serve to receive, namely make contact with, the articles in question, in the present case the sleeves 11. A radially outward-pointing surface of the support block 40 is equipped with suction holes 41, which are connected by suction channels 42 to a central source of suction. As can be seen from FIG. 4, the angled suction channels 42 of each support block 40 lead to an annular channel 43 of a fixed facing plate 44 resting against the turret plate 39. This facing plate is in turn fixedly mounted on the main axle 18. The facing plate 44 at the same time forms the lateral cover of the combining unit 10, on this side.

The holders 22 in each case comprise a side stop 45, radially movable relative to the support blocks 40, with two support arms 46 and 47. The movements are in each case transmitted by a slide rod 48, which enters, by a sensor roll 49, on an angled end, into a control slot 50 of the facing plate 44. This is so constructed that during the revolution of the turret 20, the side stops 45 move radially outwards or inwards. The slide rods 48 are each guided in a guide member 51 of the turret plate 39.

As a result of the mobility of the side stops 45, the support arms 46, 47 can be completely retracted inwards (lower part of FIG. 3), so that the outward-facing surfaces of the support block 40 are exposed and are able to receive articles. Hence, it is possible to receive articles with transverse dimensions larger than the distance between the support arms 46, 47. This is the case, in the present instance, if the sleeves 11 are fed to the support blocks 40 in their flat compressed shape and are picked up by the said blocks. Only after the sleeve 11 has been erected to give a three-dimensional, namely cuboid, shape, are the side stops 45 moved radially outwards and now embrace, by means of the support arms 46, 47, the article concerned, namely the sleeve 11, at its sides.

The (immobile) side walls 24 of the pockets 21 of the turret 19 are also mounted on the turret plate 39.

In order to facilitate the introduction of the slide 12 into the sleeve 11 which in each case faces it in the axial direction, an introducing aid, which revolves with the sleeve, is allotted to each of the sleeves 11. This aid consists of four corner guides 52, which are pivotably mounted in the region of the corners of the sleeve 11, on the entry side of the sleeve. The pivot axles 53 for these corner guides 52 are arranged diagonally so that the corner guides 52 can be pivoted, from a retracted position, into the corners of the sleeve 11 (see FIGS. 9 and 10). The movement whereby the corner guides 52 enter the mouth of the sleeve 11 consists of a superposed pivoting movement and axial movement. The former is executed by the actual slide 12 which moves past the corner guides 52. A movement, synchronous therewith, of the corner guides 52 in the axial direction into the sleeve 11 is effected by a carrier 54, which in each case is connected to a guide rod 33, movable in the axial direction. The movement is controlled by the fact that the carrier 54 enters, by a sensor roll 55 provided at the lower, that is to say radially inner, end, into a corresponding control slot 56 on the outer periphery of the control disc 32. The carrier 54 is furthermore slideably mounted on the support rod 28 and is hence guided so that it can exclusively execute axial movements.

The movements of the individual movable parts of the combining unit 10 are effected by a common drive. This consists, in the present case, of a drive wheel 57 mounted on the main axle 18, to which wheel is connected a drive disc 58 which also revolves with it. The drive disc 58 is fixedly connected, by the axially parallel support rods 28, to the turret plate 39 which serves as the facing member. The guide rods 33 are axially slideably mounted, by their ends, both in the drive disc 58 and in the turret plate 39. The combining unit 10, which executes a plurality of functions, is thus of very compact and clearly set-out construction.

A particular application is the transfer, to a continuously revolving conveyor, that is to say to the turrets 19 or 20, of articles which are provided cyclically, that is to say discontinuously. In the present case, the slides 12, provided with the cigarettes, are supplied by the conveyor 15, constructed as a chain conveyor, and in fact are supplied successively, each by a driver 59. The articles (slides 12) are lifted by a lever 60 of the lifting apparatus 14 from the conveyor 15 and are fed to the transfer apparatus 13.

The transfer apparatus 13 consists in the present case of two groups of driver pockets 61. The construction of these driver pockets 61 is such that upright pegs 63, that is to say pegs pointing approximately in the radial direction, are in each case located at the ends of mutually opposite stays 62. Two of these pegs 63 rest against opposite sides of the articles, namely of the slides 12. The two stays 62 are connected to one another by a cross-member 64. The latter, in turn, is located at the end of a radial conveyor arm 65 or 66. The carrier pockets 61 are accordingly open both radially and at the sides.

A group of three conveyor arms, 65 on one side and 66 on the other side, connected to one another in a star shape at equal angular spacings, forms one unit. The conveyor arms, 65 on one side and 66 on the other side, are each separately rotatably mounted on a shaft 69 by means of a hub 67 and 68 respectively. The conveyor arms 65, 66 and hence the driver pockets 61 are driven at uneven peripheral speed, namely in such a way that when receiving an article, that is to say in the position adjacent to the lifting apparatus 14, the particular conveyor arm 65, 66 stops momentarily. Thereafter, it accelerates until it reaches the peripheral speed of the turret 19 or of the pockets thereof. The use of two, mutually independently movable, groups of driver pockets 61 ensures that stopping, accelerating and momentarily running synchronously with the turret 19 can take place in phases of motion which follow each other in rapid succession, and hence with correspondingly high productivity of the machine. During this movement, the conveyor arms 65 or 66, with their drive pockets 61, successively enter the positions of acceptance and release of an article. Whilst, accordingly, one conveyor arm 65 is brought to a stop, another conveyor arm 66 is accelerated to the peripheral speed of the pockets 21.

A common drive is alloted to the two groups of conveyor arms 65 and 66. For this purpose, a two-arm drive member 70 is fixedly mounted on the shaft 69. This drive member 70, revolving with the shaft 69, is provided, at each end, with a bearing 71 for a drive peg 72. This axially parallel drive peg 72 is provided, on an arm 73, with a sensor roll 74, which engages in a control slot 75 of a control disc 76 which is rotatably mounted on the shaft 69. As a result of the control movements of the sensor roll 74, the drive peg 72 is caused, via the arm 73, to execute rotary movements during the revolution of the drive member 70.

At the opposite end of the drive peg 72, a guide fork 77, which runs transversely, that is to say radially, is attached. A driver roll 79, mounted on the conveyor arm 65 or 66, runs in the slit 78 of the fork.

Accordingly, a drive is transmitted to the conveyor arms 65, 66 which is the resultant of, on the one hand, the movement of the continuously revolving drive member 70 and, on the other hand, of the movements of the drive peg 72 superposed thereon.

The driver pockets 61 are located at the ends of the conveyor arms 65, 66 in such a way that for adjoining conveyor arms 65, 66 these driver pockets 61 are in one plane. The same is true of the driver rolls 79.

The articles, namely the slides 12, are moved along an arc-shaped, fixed conveyor track 80 by the driver pockets 61. The conveyor track 80 consists of two lateral angle-pieces 81, 82, each in the approximate shape of a quarter-circle arc. The articles rest, with their ends, on the lower arms of these angle-pieces 81, 82.

The conveyor track 80 leads directly to the combining unit 10, and in particular to its turret 19. The conveyor track 80 ends in the track in which the pockets 21 move. The angle-pieces 81, 82 run on either side of these pockets 21 (see FIG. 8). As a result, the articles can be accepted by the pockets 21 without sideways movement. For such acceptance, the pockets 21, or their side walls 24, 25, enter the zone between the pegs 63 of the driver pockets 61.

The articles, namely the slides 12, are lifted by a lifter 83 of the lifting apparatus 14 from the conveyor 15 and are introduced from below into the driver pocket 61, which is open at the bottom, of the transfer apparatus 13. The lifter 83 consists of a support surface 84, which is open on the side facing the arriving articles, so that the articles can be transported by the drivers 59 of the conveyor 15 onto the lifter 83. On the opposite side, the articles are supported against a stop 85, which thereby determines the precise relative position of the article on the lifter 83.

The lifter 83 is now pushed in an upwards parallel direction, namely on an arc-shaped track which runs in the direction of travel of the conveyor 15 and upwards. Accordingly, the articles are taken off the conveyor 15 without an abrupt change in the direction of travel, and hence gently.

The lifter 83 is mounted by an angle-piece 86 on parallelogram guides 87 and 88. These, by pivoting to and fro, provide the angularly upwards-directed parallel movement of the lifter 83 or of the support surface 84. The drivers 59, which continue to run, ensure that the articles rest against the stop 85 during this upward movement.

Since, in the zone of transfer of the articles to a downward-pointing driver pocket 61, the angle-pieces 81 and 82 of the conveyor track 80 are constructed without the lower arms, which act as a support for the articles, it is necessary, in such a case, that after the introduction of the articles into the driver pockets 61 some other support for the articles should be provided until the articles have arrived in the region of the arms 89 as a result of the further movement of the driver pocket 61. For this purpose, holder bars 90, 91 which can be pivoted laterally against the article are provided. These bars are provided, on the sides facing the articles, with a recess 92 which possesses a lower domed support surface 93 for supporting the articles. The holder bars 90 and 91, and their support surface 93, are so arranged, in the holding position, that the support surfaces 93 form an extension or prolongation of the arms 89 of the angle-pieces 81 and 82. Accordingly, after having introduced the article into the driver pocket 61, the lifter 83 can immediately return to the starting position. By appropriate synchronous movement, the holder bars 90 and 91 are laterally pivoted against the article, as a result of which the support surfaces 93 support the article from below. During the continued movement of the driver pocket 61, which now commences, the article passes from the support surfaces 93 onto the adjoining arms 89 of the conveyor track 80.

The holder bars 90, 91 are each mounted on double-arm levers 94 and 95. Of these, the lever 95 is subjected to a reciprocating motion by a slide rod 96. The movements of the lever 95 are transmitted by an intermediate member 97, with a reversal of direction, to the angle-shaped lever 94.

A further slide rod 98 serves to drive the lifter 83 via a link plate 99. The levers 94 and 95, the parallelogram guides 87, 88 and the link plate 99 are respectively mounted on the same axles.

The apparatus is provided with a further device for feeding articles into a turret of the combining unit 10. This device is a rocker 16, which here serves to introduce the laid-flat sleeves 11 into the turret 20. The rocker 16 is provided with a flat receiver 100 for receiving the sleeves 11. The precise relation position of the sleeve 11 on this receiver 100 is determined by a stop 101.

The rocker 16 is arranged substantially tangentially to the turret 20 (see, in particular, FIG. 3). The movement of the rocker 16 is such that the sleeve 11 is fed in the radial direction to the turret 20 or is fed in the radial direction to the support block 40 of a holder 22, with simultaneous movement in the direction of the revolving turret 20. This superposed movement is achieved through the ends of the rocker 16 respectively being connected to a rocker arm 102 and a crank 103. The movements are so selected that the abovementioned motion is executed. In the position facing away from the turret 20, the rocker 16 is charged with a sleeve 11. The latter is transferred to the turret 20 by resting against the support block 40, which, as a result of the suction hole 41, immediately grasps the sleeve 11 and carries it away.

As explained above, the sleeves 11 are introduced in the lay-flat form into the turret 20. For combining the sleeve 11 with the slide 12, the sleeve must be erected so as to assume its final cuboid position. For this purpose, the erector 17 is allotted to the turret 20 in the present illustrative embodiment. The erector is mounted coaxially with the turret 20, namely rotatably mounted on one end of the axle 104, as an extension of the main axle 18 (see FIG. 4).

The erector 17 consists of a support plate 105 rotatably mounted on the end 104 of the axle. This plate is caused to undergo a to-and-fro pivoting motion by means of a drive rod system 106. The latter engages in a swivel bearing 107, on the support plate 105, at a distance from the end 104 of the axle, that is to say at a distance from the rotary bearing of the support plate 105.

The erector 17 is so constructed that two holders 22 of the turret 20, or two sleeves 11 contained in these holders, are erected simultaneously. For this purpose, the erector 17 is equipped with two conjointly driven lifting arms 108, 109. A suction head 110, 111 is located at the radially outer end of each lifting arm 108, 109. This suction head is brought up to the particular outer wall 112 of the sleeve 11 and gripped by suction. Accordingly, the sleeve 11 is held by suction, on the one hand on the support block 40, and on the other hand by the suction head 110 or 111.

The lifting arms 108, 109, and, together with these, the suction heads 110, 111 execute a semi-circular pivoting movement corresponding to the process of erecting the sleeve 11. During this movement, the sleeve 11 is first brought into the upright position and then "folded-back" beyond this. Thereafter, the desired upright cuboid shape of the sleeve 11 is re-established.

To execute this movement, the lifting arms 108, 109 are connected to a shared drive by parallelogram plates 113, 114. This drive consists of a main wheel 115 (a gear wheel) and auxiliary wheels 116 (also gear wheels) which enmesh therewith. The parallelogram plates 113, 114 are each fixedly connected to such an auxiliary wheel 116.

The rotary movements of the main wheel 115 are transmitted via the auxiliary wheels 116 to all parallelogram plates 113, 114 and from these to the lifting arms 108, 109, in the sense that the described movement of the suction heads 110, 111 is executed. The suction heads 110, 111, or the suction surfaces thereof which face the wall 112, thereby execute a parallel movement.

The drive of the main wheel 115 is effected separately, namely via a connecting rod 117, which is connected to one end of a crankshaft 118. The opposite end of the crankshaft 118 drives the main wheel 115 and, for this purpose, is eccentrically hinged to a crank arm 119 of the main wheel 115. The end of the crankshaft 118 which faces the connecting rod 117 is joined to a connecting member 120 which in turn is carried by the pivot bearing 107.

The individual phases of the movement of the erector 17 are shown schematically in FIGS. 12 to 17.

Figure 12:
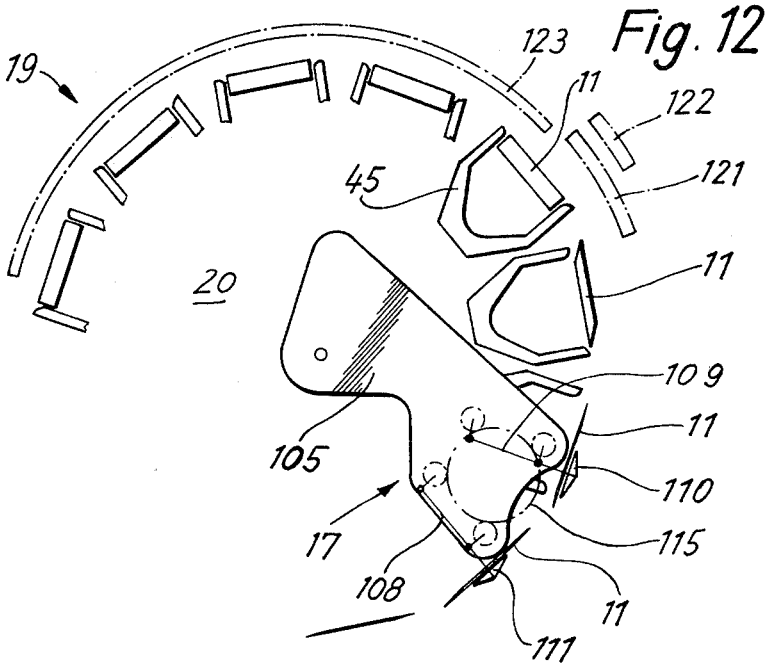
Figure 13:
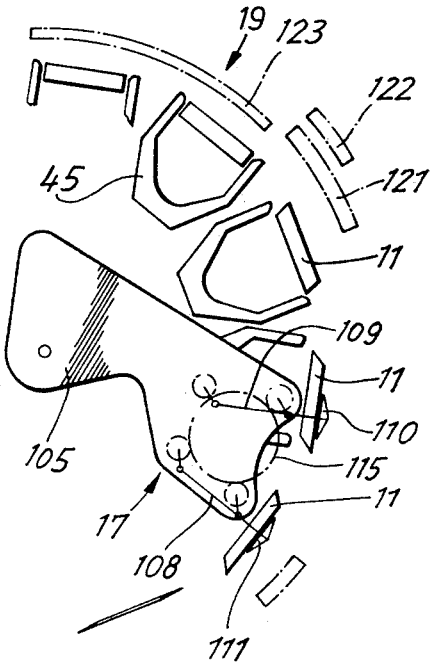
Figure 14:
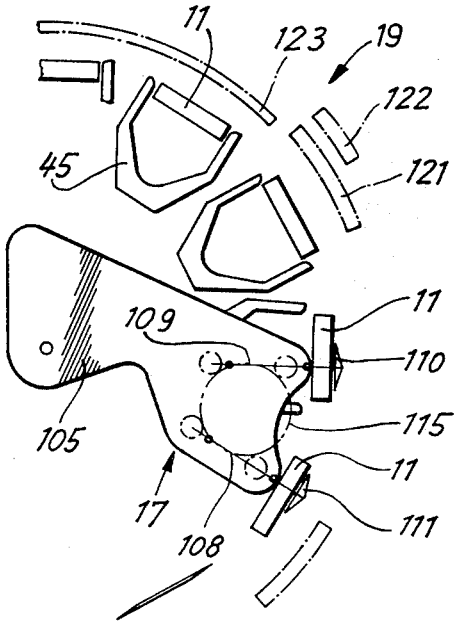
Figure 15:
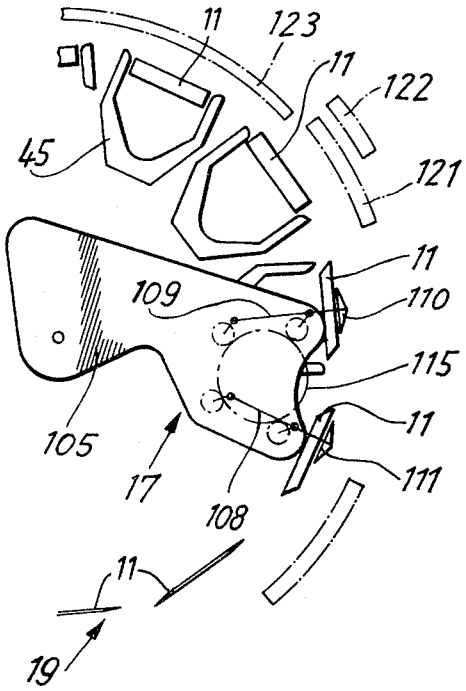
Figure 16:
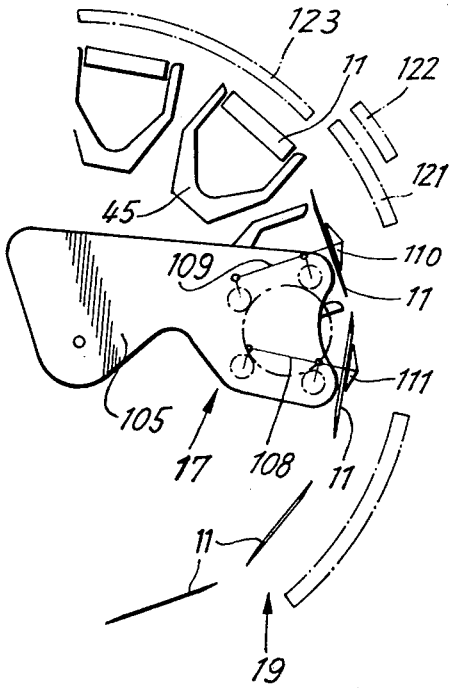
Figure 17:
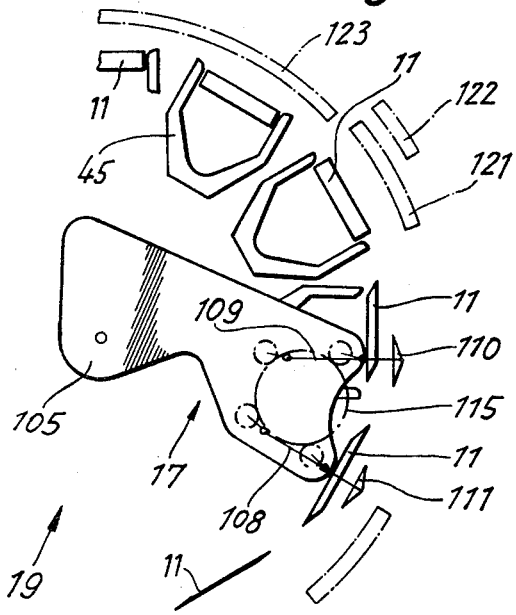

FIG. 12 shows the starting position, in which the suction heads 110, 111 are brought up against the wall 112 of two sleeves 11 which are still in the lay-flat form. The erector 17 now continues to travel for some distance with the turret 20. During this movement, the lifting arms 108, 109 are moved in the manner described, as a result of which the sleeve 11 is brought, from its initially flat position, via a slanting intermediate position as shown in FIG. 13, into the cuboid position according to FIG. 14. However, the movements of the erector 17 go beyond the position shown in FIG. 14, namely via an (oppositely) slanting position, as shown in FIG. 15, as far as an upper final position shown in FIG. 16. In this, the sleeve 11 is again pressed flat as in FIG. 12, but in the opposite direction. As a result, the sleeve 11 is over-stretched in the region of the edges, or "folded-back". If now the suction heads 110, 111 are released from the wall 112 of the sleeve 11 (FIG. 17), the sleeve 11 assumes the desired cuboid position by virtue of the strain in the material. As the turret 20 continues to travel, the side stops 45 are moved into the radially outer position and now secure the cuboid shape of the sleeve 11 by means of the support arms 46, 47. The erector 17 reverts to the starting position shown in FIG. 12.

As a result of the simultaneous erection of two sleeves 11 it is possible to set the movements of the erector 17 to suit the relatively high speed of revolution of the turret 20. The turret 20 has moved on by an amount corresponding to two holders 22 when the erector 17 reverts to the starting position after one cycle.

In FIG. 12, the hatched arc-shaped strips represent the phases of the movement of the combining unit 10. The segment 121 represents a zone of about 40°, in which the radial movement of the side stop 45 takes place. The segment 122—about 20°—corresponds to the corner guides 52 being brought into the working position in relation to the sleeve 11. Finally, the segment 123 outlines the process of pushing the slide 12 into the sleeve 11.

At the end of the segment 123 is located an ejector 124, by means of which the finished packages are expelled from the holders 22 and charged onto a packaging conveyor 125. In the present case, the ejector 124 is mounted on the same axis 126 as the rocker arm 102 for the rocker 16. This results in a simple construction of the apparatus.

I claim:

1. A method for inserting slides (12) into sleeves (11) in a packaging machine, particularly for forming cigarette packs, characterised by: rotationally and coaxially conveying a plurality of radially disposed slides and sleeves at the same speed along adjacent and spaced coaxial circular tracks of the same diameter, and individually axially shifting each slide towards an associated and adjacent sleeve to effect its insertion therein during said rotational conveyance.

2. A method according to claim 1, further comprising initially erecting each sleeve from a flat starting position during its conveyance along the circular track in preparation for a slide insertion.

3. A method for introducing packages (12) into a circular track of revolution of continuously revolving pockets (21) of a conveyor turret (19) characterized by: initially feeding the packages at a speed lower than that of the conveyor turret, accelerating the packages along a track leading to the turret until they reach the speed of the turret, and individually transferring the packages to the turret pockets while the package and pocket speeds are momentarily identical.

4. A method according to claim 3, wherein the packages are accelerated along a circular track (80) axially parallel to the turret over a ninety degree arc of the track, said circular acceleration track tangentially entering the circular track of revolution of the turret pockets in a zone in which the packages are transferred to the pockets.

5. An apparatus for inserting slides (12) into sleeves (11) in a packaging machine, particularly for forming cigarette packs, comprising: two coaxially mounted equal diameter turrets (19, 20) revolving continuously and at the same speed, a plurality of radially disposed and circumferentially spaced slide receiving pockets (21) on one of said turrets, and a plurality of radially disposed and circumferentially spaced sleeve receiving holders (22) on the other one of said turrets, and a plurality of axially oriented conveying rams (23) for individually axially shifting each slide towards an associated and adjacent sleeve to effect its insertion therein during the rotation of said turrets.

6. An apparatus according to claim 5, further comprising four pivotally mounted and axially movable corner guides (52) disposed at an open end of each sleeve to facilitate the insertion of a slide.

7. An apparatus according to claims 5 or 6, wherein each sleeve holder (22) comprises a support block (40) mounted at the outer periphery of a turret plate (39), and vacuum suction means in each support block for engaging a sleeve.

8. An apparatus according to claim 7, further comprising a radially movable side stop (45) having support arms (46, 47) for guiding the lateral sides of a sleeve mounted proximate each sleeve holder.

9. An apparatus for feeding individually and discontinuously conveyed slides (12) to pockets (21) of a continuously revolving conveyor turret (19), comprising: a rotary transfer apparatus (13) axially parallel to the turret and including an arcuate conveyor track (80) tangentially leading to the outer periphery of the turret, means for accelerating the slides along the track up to the speed of revolution of the turret, and means for individually transferring each slide to a turret pocket while the speeds of the slides and pockets are momentarily identical.

10. An apparatus according to claim 9, further comprising: a linear supply conveyor (15) for the slides, a plurality of driver pockets (61) radially disposed and circumferentially spaced on the transfer apparatus and movable non-uniformly along a circular path for removing the slides from the supply conveyor during a momentary stationary position, and for thereafter accelerating the slides along the conveyor track.

11. An apparatus according to claim 10, wherein the transfer apparatus comprises two interleaved groups of three driver pockets each, and two differently and non-uniformly driven sets of carrier arms (65, 66) each mounting three driver pockets, whereby the two groups are employed in alternating succession for receiving a slide.

12. An apparatus according to claim 11, further comprising a uniformly revolving drive member (70) for driving each carrier arm non-uniformly via an intermediate drive mechanism (77, 78, 79).

13. An apparatus according to claims 10, 11 or 12, further comprising a lifter (83) movable along an arc-shaped path for individually transferring the slides from the supply conveyor to the driver pockets.

14. An apparatus according to claim 13, wherein the driver pockets are open at the bottom, and further comprising a pair of opposed holder bars (90, 91) each having an arc-shaped support surface (93), and means for pivoting the holder bars laterally against each slide in the zone of transfer of the slides from the supply conveyor to the driver pockets, said holder bars serving as an extension of the conveyor track.

15. An apparatus according to claim 5, further comprising a rocker (16) disposed below and facing the outer periphery of said sleeve turret (20), and means including a crank (102, 103) connected to one end of the rocker for moving it towards the periphery of the sleeve turret and in the direction of revolution thereof over a predetermined distance and at the same speed.

16. An apparatus according to claim 5 further comprising an erector (17) pivotally mounted coaxially on the sleeve turret for opening flattened sleeves held by the sleeve holders (22) while the sleeve turret rotates through a circular arc, and means for reciprocatingly driving said erector.

17. An apparatus according to claim 16, wherein the erector (17) comprises two outwardly movable lifting arms (108, 109) each having a suction head (110, 111) for gripping a radially outward wall (112) of a flattened sleeve.

* * * * *